US008460050B2

(12) United States Patent
Tu

(10) Patent No.: US 8,460,050 B2
(45) Date of Patent: Jun. 11, 2013

(54) TRANSMISSION MECHANISM FOR REMOTE-CONTROLLED TOY HELICOPTER

(76) Inventor: Ta-Sen Tu, Taichung (TW)

( * ) Notice: Subject to any disclaimer, the term of this patent is extended or adjusted under 35 U.S.C. 154(b) by 287 days.

(21) Appl. No.: 13/046,112

(22) Filed: Mar. 11, 2011

(65) Prior Publication Data

US 2012/0231695 A1 Sep. 13, 2012

(51) Int. Cl.
*A63H 27/127* (2006.01)
*A63H 27/00* (2006.01)

(52) U.S. Cl.
USPC ..... 446/37; 244/17.11; 244/17.13

(58) Field of Classification Search
USPC ..... 446/36, 37, 38, 57, 58, 61, 230, 232, 446/236, 238, 454–456; 244/17.25, 17.11, 244/17.13, 17.19, 17.21, 17.23
See application file for complete search history.

(56) References Cited

U.S. PATENT DOCUMENTS

| | | | | |
|---|---|---|---|---|
| 5,628,620 | A * | 5/1997 | Arlton | 416/114 |
| 7,425,168 | B2 * | 9/2008 | Van de Rostyne | 446/36 |
| 8,052,500 | B2 * | 11/2011 | Van de Rostyne et al. | 446/36 |
| 8,177,600 | B2 * | 5/2012 | Huang et al. | 446/37 |
| 2007/0105475 | A1 * | 5/2007 | Gotou et al. | 446/37 |
| 2010/0178836 | A1 * | 7/2010 | Huang et al. | 446/37 |

* cited by examiner

*Primary Examiner* — Kien Nguyen
(74) *Attorney, Agent, or Firm* — Rosenberg, Kleni & Lee

(57) ABSTRACT

A transmission mechanism includes an upper holder block and a lower holder block respectively coupled to the shaft of the rotor system of a remote-controlled toy helicopter at different elevations, a stabilizer mounted at the upper holder block, two second links bilaterally coupled between the upper holder block and the lower holder block, a helicopter motor, and a first link coupled between the lower holder block and the output shaft of the helicopter motor for enabling the first link, the lower holder block, the second links, the upper holder block and the stabilizer to be relatively moved upon rotation of the motor.

3 Claims, 5 Drawing Sheets

TRANSMISSION MECHANISM FOR REMOTE-CONTROLLED TOY HELICOPTER

BACKGROUND OF THE INVENTION

1. Field of the Invention

The present invention relates to a toy helicopter and more particularly, to a transmission mechanism for use in a remote-controlled toy helicopter, which has a simple structure and light weight and greatly enhances the transmission efficiency.

2. Description of the Related Art

A conventional transmission mechanism for use in a remote-controlled toy helicopter, as shown in FIGS. 1 and 2, comprises an upper holder block 3 coupled to the shaft of the main rotor system 1 to support a stabilizer 2, a lower holder block 4 coupled to the shaft of the main rotor system 1 and spaced below the upper holder block 3, fourth links 5 coupled between the upper holder block 3 and the lower holder block 4, third links 6 respectively coupled to the fourth links 5, second links 7 respectively coupled to the third links 6, a helicopter motor 9, and first links 8 coupled between the helicopter motor 9 and the second links 7. During operation of the helicopter motor 9, the first, second and third links 8;7;6 are driven to move the lower holder block 4, causing the fourth links 5 to bias the upper holder block 3 and to further achieve control of the angle of the stabilizer 2.

The above prior art design is functional; however, it has numerous drawbacks:

(1) The mechanism uses multiple links 8;7;6;5 to achieve transmission, complicating the structure and lowering the transmission speed.

(2) The links 8;7;6;5 are made of metal, increasing the weight of the transmission mechanism and fuel consumption.

(3) The main rotor system 1 and the stabilizer 2 define a 90-degrees contained angle, causing the stabilizer 2 to bear a heavy wind resistance.

SUMMARY OF THE INVENTION

The present invention has been accomplished under the circumstances in view. It is one object of the present invention to provide a transmission mechanism for remote-controlled toy helicopter, which has a simple structure and light weight and greatly enhances the transmission efficiency.

To achieve this and other objects of the present invention, a transmission mechanism comprises an upper holder block and a lower holder block respectively coupled to the shaft of the rotor system of a remote-controlled toy helicopter at different elevations, a stabilizer mounted at the upper holder block, two second links bilaterally coupled between the upper holder block and the lower holder block, a helicopter motor, a first link coupled between the lower holder block and the output shaft of the helicopter motor for enabling the first link, the lower holder block, the second links, the upper holder block and the stabilizer to be relatively moved upon rotation of the motor, a supplementary member set between the upper holder block and the lower holder block and having two opposing notches for the passing of the second links respectively, and two connection members bilaterally and pivotally coupled between the upper holder block and the second links.

DETAILED DESCRIPTION OF THE PREFERRED EMBODIMENT

Figure 1:
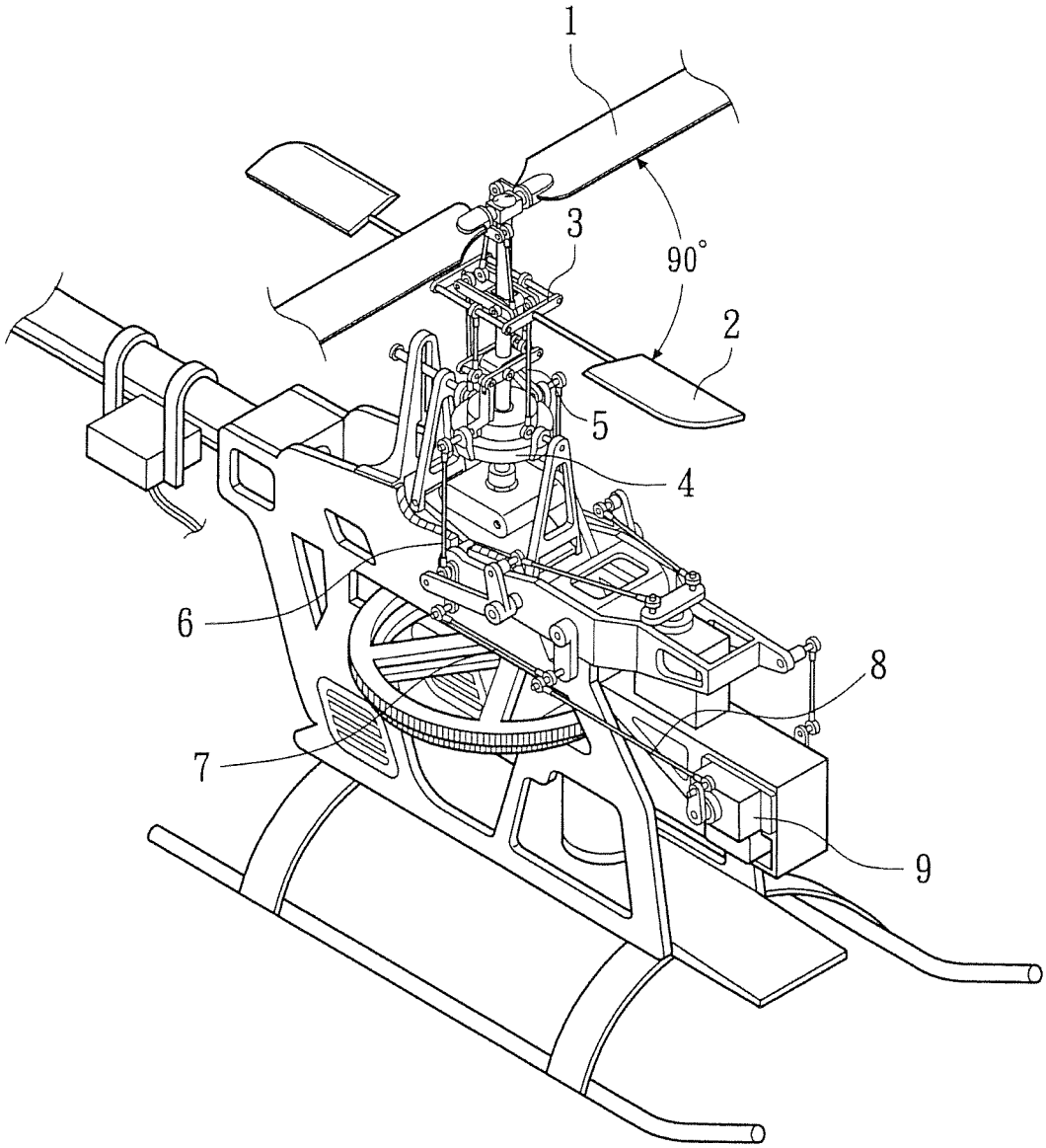
FIG. 1 PRIOR ART
FIG. 1 is a schematic elevational view illustrating a transmission mechanism installed in a remote-controlled toy helicopter according to the prior art.
Figure 2:
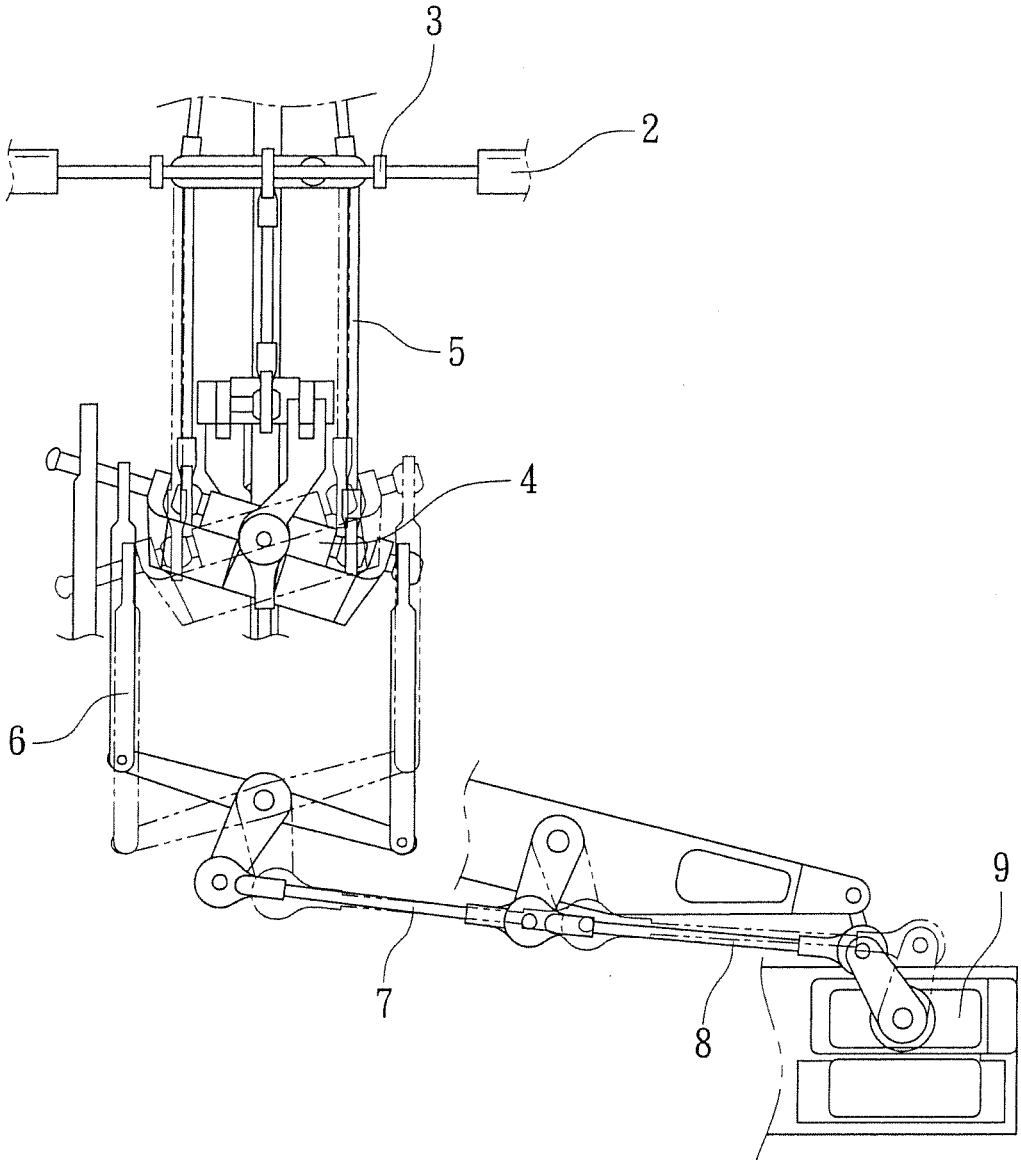
FIG. 2 PRIOR ART
FIG. 2 is an enlarged view of a part of the transmission mechanism for remote-controlled toy helicopter in accordance to the prior art.
Figure 3:
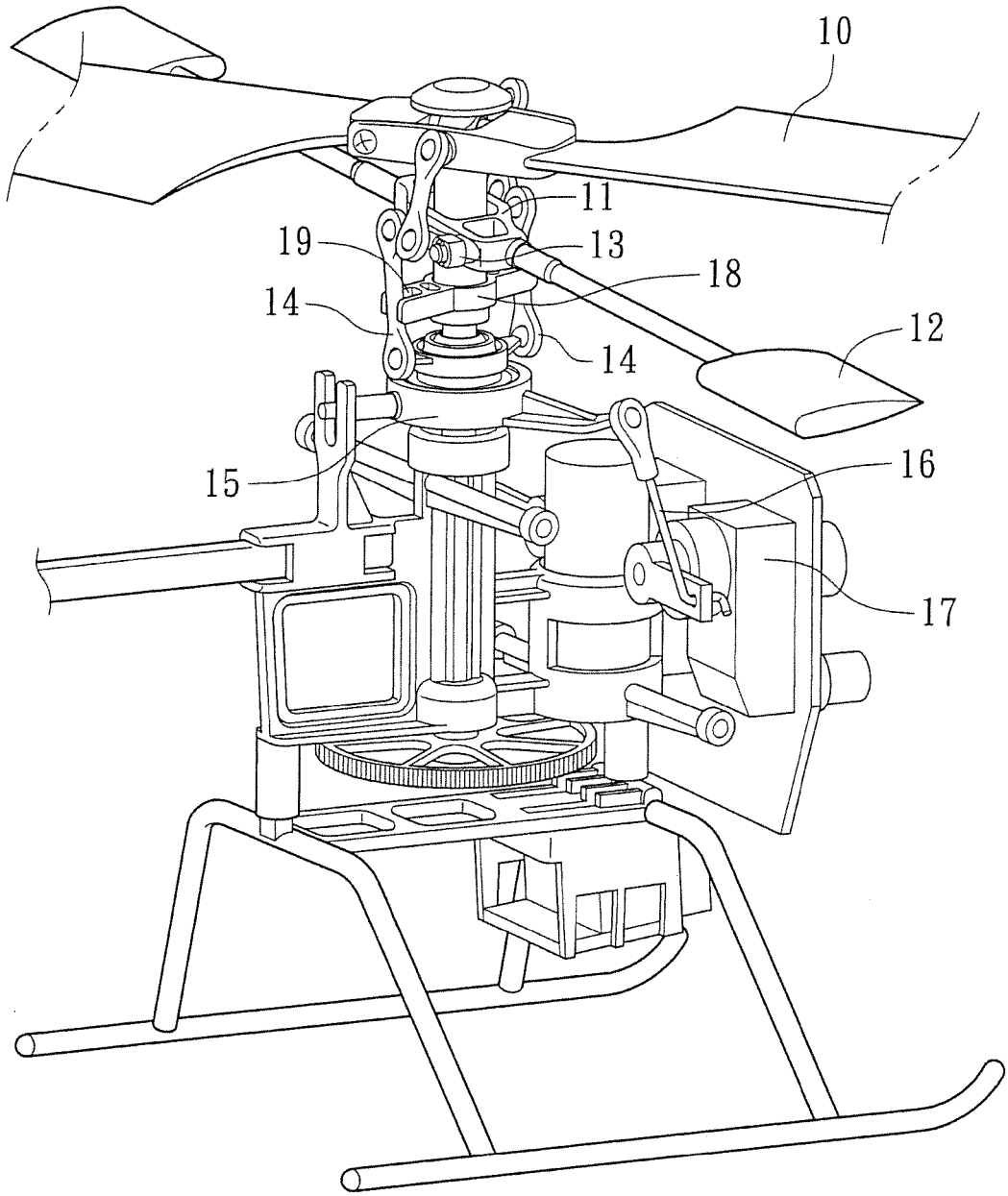
FIG. 3 is a schematic elevational view illustrating a transmission mechanism installed in a remote-controlled toy helicopter according to the present invention.
Figure 4:
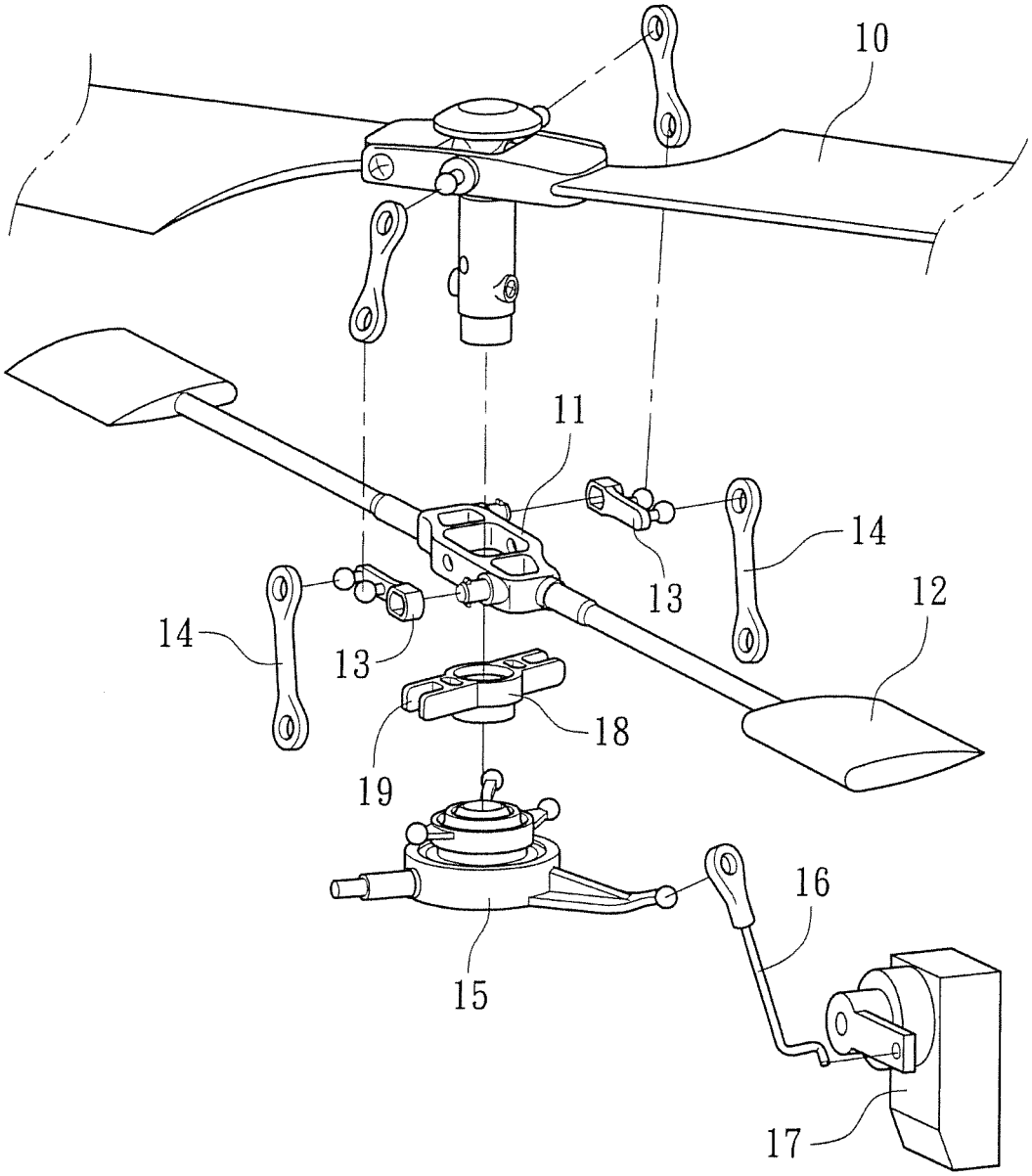
FIG. 4 is an exploded view of the transmission mechanism for remote-controlled toy helicopter in accordance with the present invention.

Referring to FIGS. 3-6, a transmission mechanism in accordance with the present invention is shown installed in a remote-controlled toy helicopter, comprising an upper holder block 11 and a lower holder block 15 respectively coupled to the shaft of the remote-controlled toy helicopter's rotor system 10 at different elevations, a stabilizer 12 mounted at the upper holder block 11, two second links 14 bilaterally coupled between the upper holder block 11 and the lower holder block 15, a first link 16 coupled between the lower holder block 15 and the output shaft of the remote-controlled toy helicopter's motor 17, a supplementary member 18 set between the upper holder block 11 and the lower holder block 15 and having two opposing notches 19 for the passing of the second links 14 respectively, and two connection members 13 bilaterally and pivotally coupled between the upper holder block 11 and the second links 14.

The invention has the advantages as follows:

(1) The transmission mechanism simply uses the first link 16 and the second links 14 to achieve transmission and control of the stabilizer 12, simplifying the structure, reducing the weight and enhancing transmission efficiency.

(2) Except the first link 16 that is made of metal, the upper holder block 11, the lower holder block 15, the supplementary member 18, the second links 14 and the connection members 13 are made by a plastic material, reducing the weight of the remote-controlled toy helicopter and saving its fuel consumption.

(3) The supplementary member 18 supports the second links 14, protecting the second links 14 against deformation.

(4) Subject to the coupling arrangement of the connection members 13 between the upper holder block 11 and the second links 14, the stabilizer 12 can be moved conveniently and rapidly to achieve flying stabilization.

Figure 5:
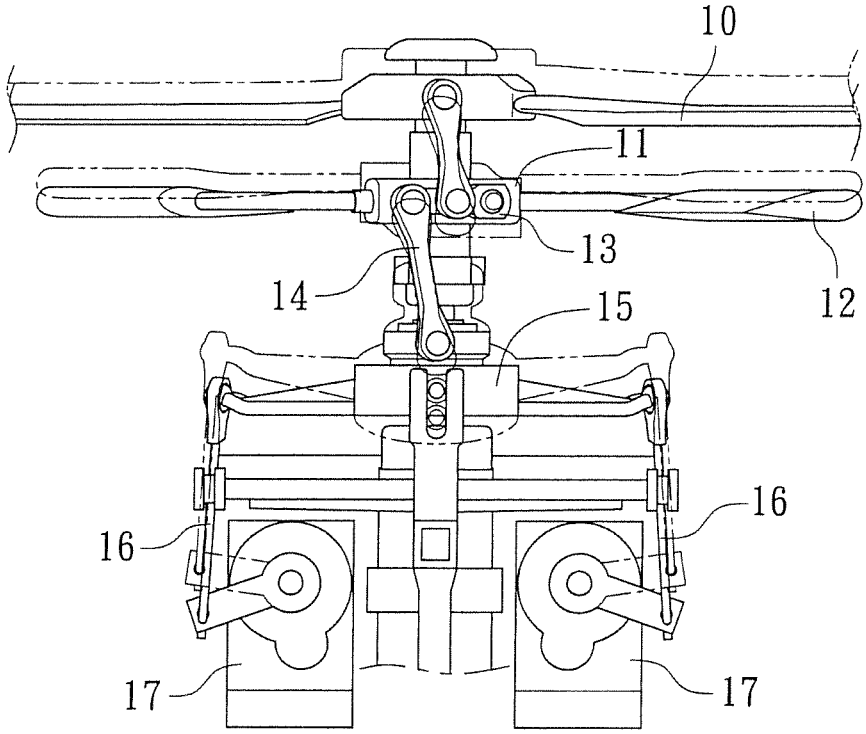
FIG. 5 is a schematic sectional front view of an alternate form of the transmission mechanism for remote-controlled toy helicopter in accordance with the present invention.
Figure 6:
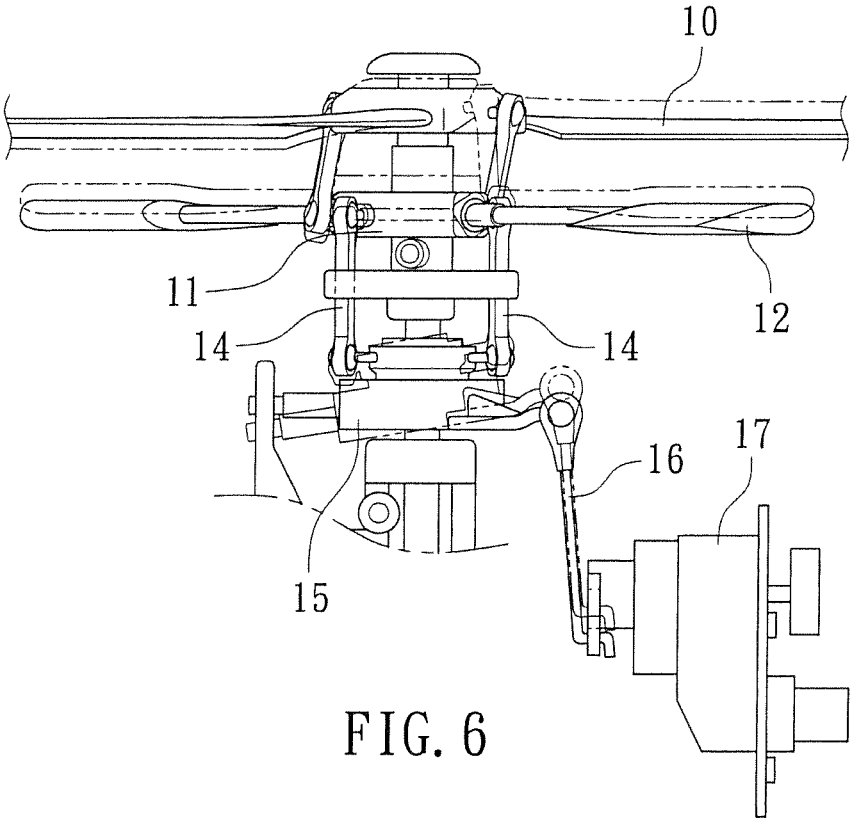
FIG. 6 is a schematic side view of a part of FIG. 5.

In an alternate form of the present invention, as shown in FIGS. 5 and 6, two motors 17 are worked with two sets of first links 16, second links 14 and connection members 13, achieving the same effects. Further, the contained angle defined between the rotor system 10 and the stabilizer 12 can be smaller than 90-degrees, reducing the wind resistance at the stabilizer 12.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A transmission mechanism used in a remote-controlled toy helicopter, comprising an upper holder block and a lower holder block respectively coupled to a shaft of a rotor system of said remote-controlled toy helicopter at different elevations, said upper holder block being adapted for supporting a stabilizer, two second links bilaterally coupled between said upper holder block and said lower holder block, a helicopter motor having an output shaft, and a first link coupled between said lower holder block and the output shaft of said helicopter motor for enabling said first link, said lower holder block, said second links, said upper holder block and said stabilizer to be relatively moved upon rotation of said motor.

2. The transmission mechanism as claimed in claim 1, further comprising a supplementary member set between said upper holder block and said lower holder block, said supplementary member having two opposing notches for the passing of said second links respectively.

3. The transmission mechanism as claimed in claim 1, further comprising two connection members bilaterally and pivotally coupled between said upper holder block and said second links.

* * * * *